US009442439B2

(12) United States Patent
Onishi

(10) Patent No.: US 9,442,439 B2
(45) Date of Patent: Sep. 13, 2016

(54) FIXING DEVICE AND IMAGE FORMING APPARATUS INCLUDING A WINDBREAK PLATE COVERING A THERMISTOR FROM A PAPER ENTRY PATH SIDE

(71) Applicant: KYOCERA Document Solutions Inc., Osaka (JP)

(72) Inventor: Shota Onishi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/963,445

(22) Filed: Dec. 9, 2015

(65) Prior Publication Data

US 2016/0187821 A1 Jun. 30, 2016

(30) Foreign Application Priority Data

Dec. 25, 2014 (JP) ..... 2014-261569

(51) Int. Cl.
*G03G 15/20* (2006.01)
*G03G 21/16* (2006.01)

(52) U.S. Cl.
CPC ..... *G03G 15/2039* (2013.01); *G03G 15/2078* (2013.01); *G03G 15/2085* (2013.01); *G03G 21/1685* (2013.01); *G03G 2221/1639* (2013.01)

(58) Field of Classification Search
CPC ..... G03G 15/2039; G03G 15/2078; G03G 15/2085; G03G 21/1685; G03G 2221/1639
See application file for complete search history.

(56) References Cited

U.S. PATENT DOCUMENTS

2005/0163524 A1* 7/2005 Shiobara ..... G03G 15/2039 399/69
2007/0154252 A1* 7/2007 Yoshida ..... B41J 29/02 400/670.3
2011/0052236 A1* 3/2011 Matsuno ..... G03G 15/2039 399/69
2015/0030345 A1* 1/2015 Murakami ..... G03G 15/2039 399/69

FOREIGN PATENT DOCUMENTS

JP 04336581 A * 11/1992
JP 06-118837 4/1994
JP 2000-137409 5/2000
JP 2002-311746 10/2002
JP 2007304294 A * 11/2007

* cited by examiner

*Primary Examiner* — David Gray
*Assistant Examiner* — Laura Roth
(74) *Attorney, Agent, or Firm* — Wenderoth, Lind & Ponack, L.L.P.

(57) ABSTRACT

A windbreak plate is assembled to a thermistor mounting member for mounting a thermistor to a housing, and the thermistor is covered by the windbreak plate from a paper entry path side. The thermistor mounting member has exposure parts which are exposed to the paper entry path from the windbreak plate. The exposure parts (a second plate part and a third plate part) are level with the windbreak plate and constitutes a part of the windbreak plate.

4 Claims, 7 Drawing Sheets

FIXING DEVICE AND IMAGE FORMING APPARATUS INCLUDING A WINDBREAK PLATE COVERING A THERMISTOR FROM A PAPER ENTRY PATH SIDE

CROSS-REFERENCE TO RELATED APPLICATION

This application is based upon and claims the benefit of priority from Japanese Patent Application No. 2014-261569 filed on Dec. 25, 2014, the entire contents of which are incorporated herein by reference.

BACKGROUND

The technology of the present disclosure relates to a fixing device having a thermistor for measuring the temperature of a fixing roller arranged in a housing and an image forming apparatus including the same.

In a fixing device, thermistors for measuring the temperature of a fixing roller are respectively arranged in a housing.

SUMMARY

A fixing device according to one aspect of the present disclosure includes a thermistor, a thermistor mounting member, and a windbreak plate. The thermistor measures a temperature of a fixing roller arranged in a housing. The thermistor mounting member is a member that mounts the aforementioned thermistor to the aforementioned housing. The windbreak plate is assembled to the thermistor mounting member and covers the aforementioned thermistor from a paper entry path side of a paper entering into the aforementioned fixing roller. The aforementioned thermistor mounting member has an exposure part exposed to the paper entry path side from the aforementioned windbreak plate. The aforementioned exposure part is level with the windbreak plate and constitutes a part of the windbreak plate.

DETAILED DESCRIPTION

Hereinafter, an example of an embodiment of the present disclosure will be described in detail on the basis of the drawings. It is noted that the technology of the present disclosure is not limited to the following embodiments.

Figure 1:
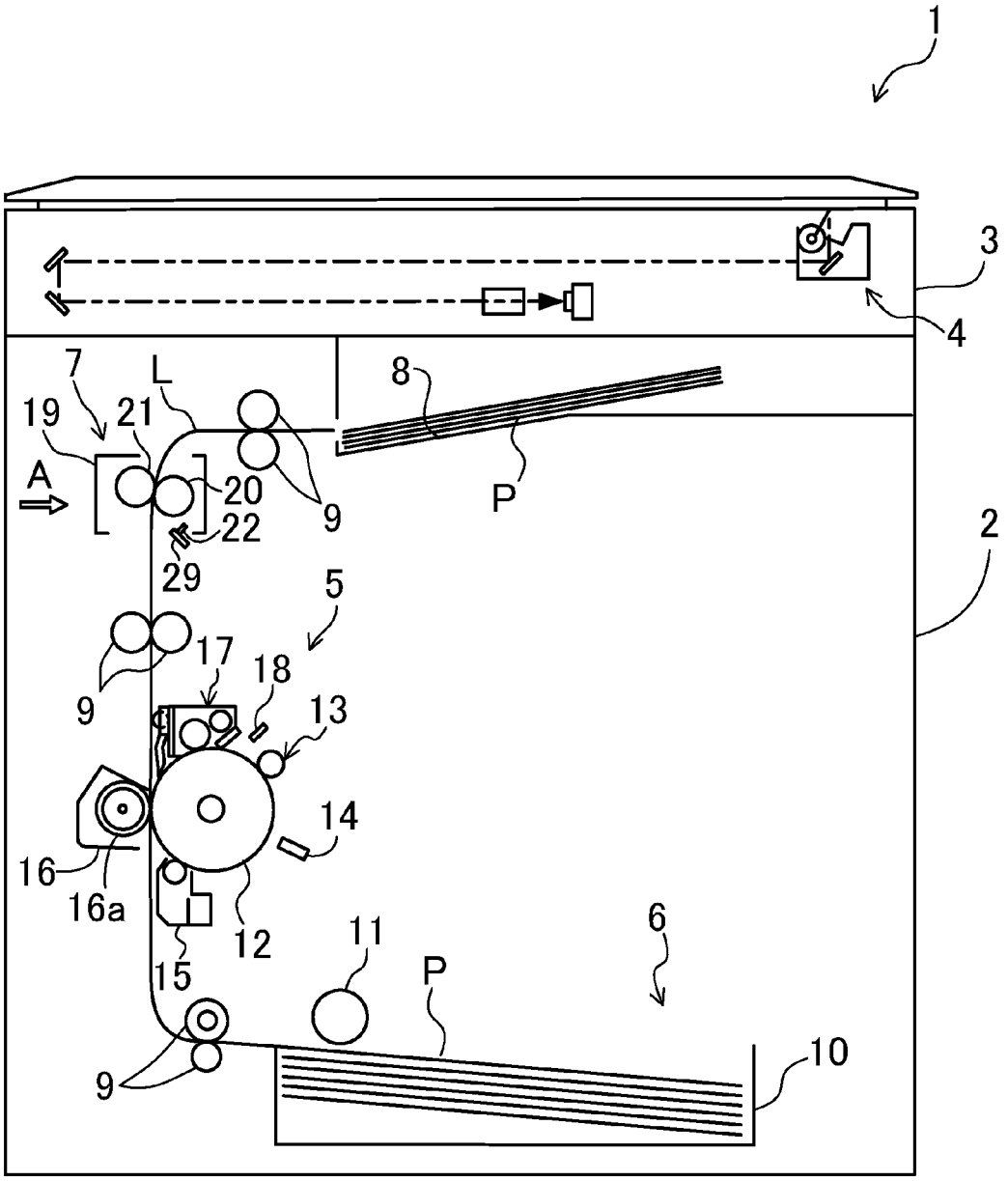
FIG. 1 is a schematic diagram illustrating an internal structure of an image forming apparatus.

FIG. 1, for example, is an image forming apparatus 1 such as a laser printer and a multifunctional peripheral. The image forming apparatus 1 has a body casing 2 and a scanner casing 3 arranged at an upper side of the body casing 2. In the scanner casing 3, a scanner unit 4 for reading a document image is accommodated, and in the body casing 2, an image forming unit 5, a paper feeding unit 6, a fixing device 7 and the like are accommodated.

The body casing 2 is provided at an upper surface portion thereof with a paper discharge unit 8. On a paper conveyance path L from the paper feeding unit 6 to the paper discharge unit 8, a plurality of conveying rollers 9 are arranged to convey a paper P while interposing the paper P therebetween.

The paper feeding unit 6 has a paper feeding cassette 10 in which the paper P is accommodated, and a pick-up roller 11 for taking out the paper P in the paper feeding cassette 10 and sending out the paper P to the paper conveyance path L. The paper P sent out from the paper feeding cassette 10 is supplied to the image forming unit 5 by the conveying rollers 9.

In the image forming unit 5, a toner image based on predetermined image data (for example, data of a document image read by the scanner unit 4) is transferred to the paper P supplied from the paper feeding unit 6, and the paper P after the transfer is supplied to the fixing device 7.

In FIG. 1, a reference numeral 12 indicates a photosensitive drum, a reference numeral 13 indicates a charging device that uniformly electrifies the peripheral surface of the photosensitive drum 12, a reference numeral 14 indicates an exposure device that forms an electrostatic latent image corresponding to the predetermined image data by irradiating laser light to the peripheral surface of the photosensitive drum 12, a reference numeral 15 indicates a developing device that supplies toner to the electrostatic latent image of the peripheral surface of the photosensitive drum 12 and develops the electrostatic latent image as a toner image, a reference numeral 16 indicates a transfer device that applies a transfer bias to a transfer roller 16*a* and transfers the toner image formed on the peripheral surface of the photosensitive drum 12 to the paper P, a reference numeral 17 indicates a cleaning device that cleans toner attached to and remaining on the peripheral surface of the photosensitive drum 12 after the transfer, and a reference numeral 18 indicates a charge eliminating device that eliminates remaining charge of the peripheral surface of the photosensitive drum 12, wherein the image forming unit 5 is configured by these elements.

The fixing device 7 includes a fixing roller 20 and a pressing roller 21 arranged in a housing 19. The fixing device 7 presses the paper P supplied from the image forming unit 5 between the fixing roller 20 and the pressing roller 21, thereby fixing the toner image to the paper P.

The paper P with the toner image fixed by the fixing device 7 is sent out to a downstream side of the paper conveyance path L by the fixing roller 20 and the pressing roller 21, and is discharged to the paper discharge unit 8 by the conveying rollers 9.

Figure 4:
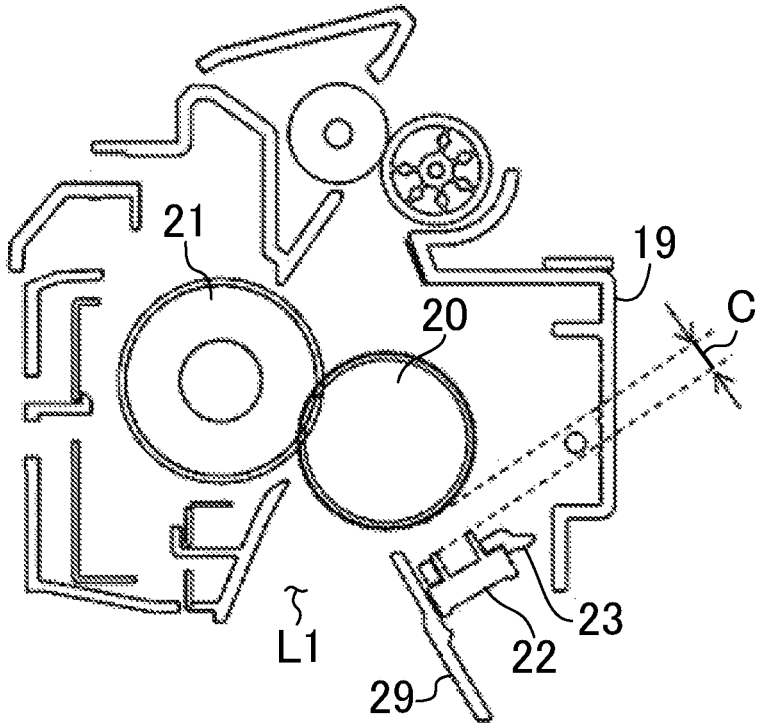
FIG. 4 is a sectional view taken along line B-B in FIG. 2 illustrating an internal structure of a fixing device.
Figure 5:
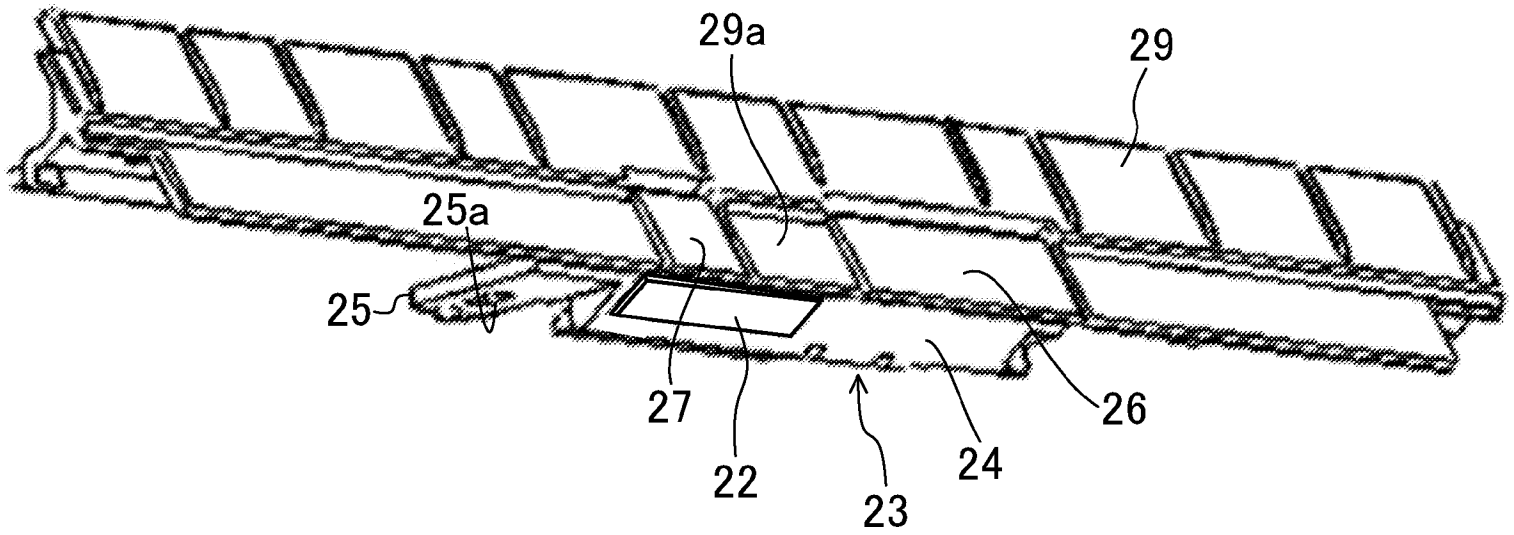
FIG. 5 is a perspective view illustrating a state in which a windbreak plate has been assembled to a thermistor mounting member.
Figure 6:
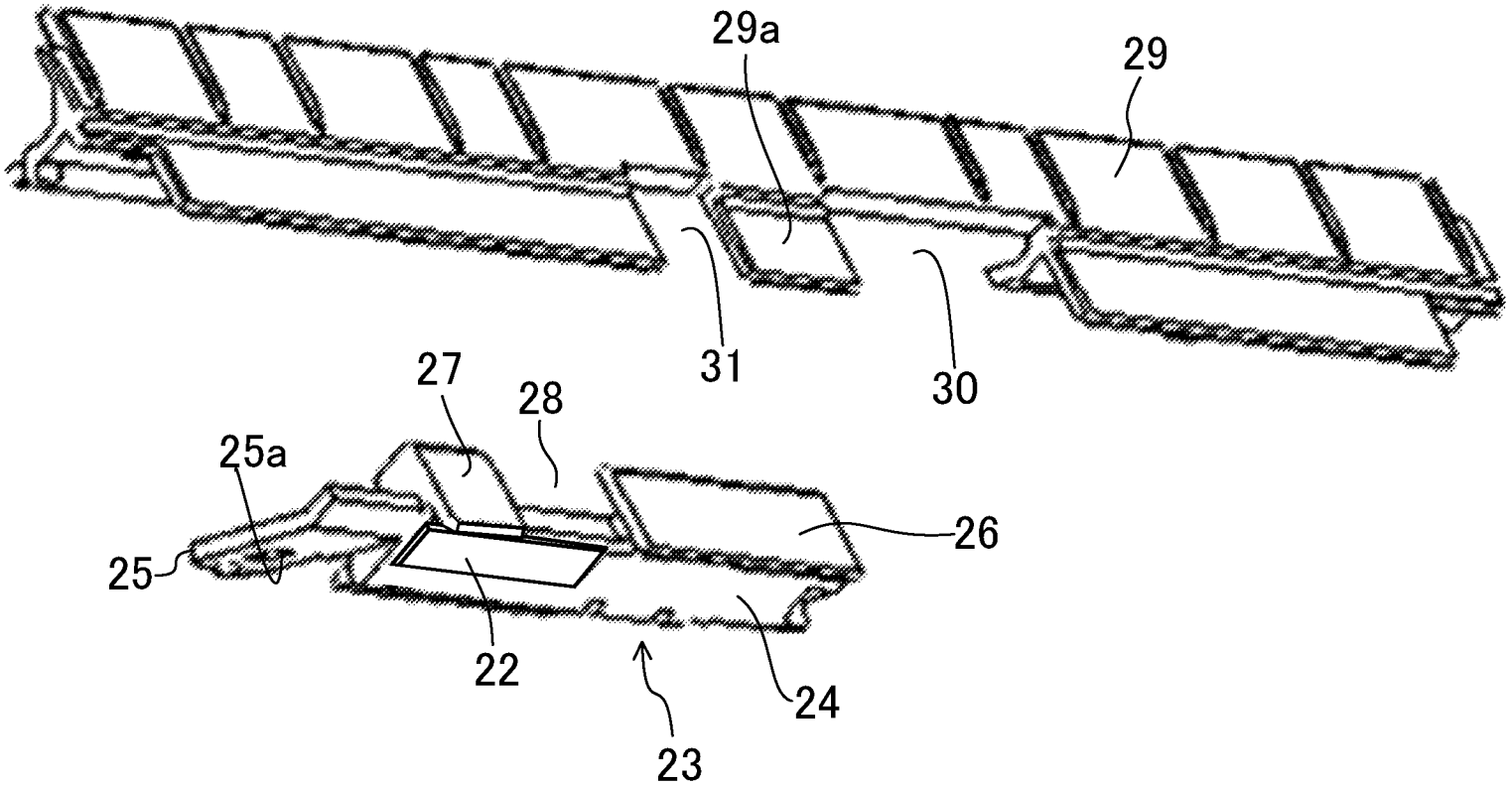
FIG. 6 is an exploded perspective view of FIG. 5.
Figure 7:
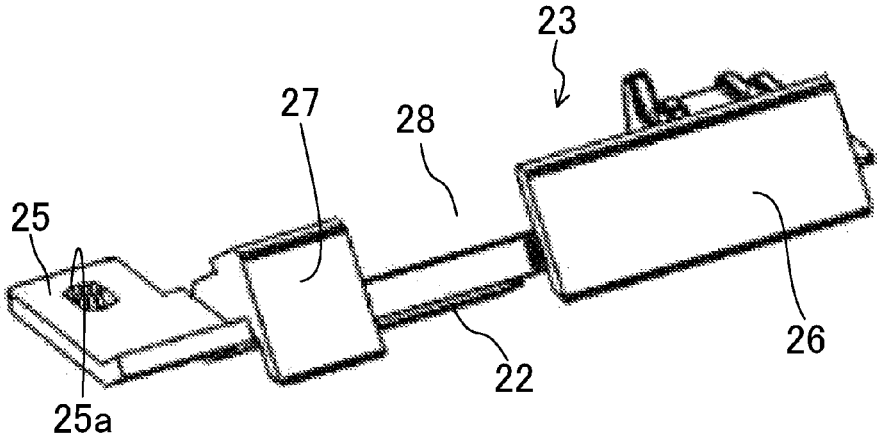
FIG. 7 is a perspective view of a thermistor mounting member.

At a paper entry path L1 side in the housing 19, as illustrated in FIG. 4, a thermistor 22 is arranged separate from the fixing roller 20 by a gap C. The thermistor 22 measures the temperature of the fixing roller 20 in a non-contact manner. The thermistor 22 is fitted to a thermistor mounting member 23 as illustrated in FIG. 5 to FIG. 7.

In detail, the thermistor mounting member 23 includes a rectangular first plate part 24, and the thermistor 22 is fitted in an area corresponding to about a half of the first plate part 24 in a longitudinal direction. At one end of the first plate part 24, which is at the thermistor 22 side, a mounting piece 25 is integrally formed with the first plate part 24. The mounting piece 25 has a mounting hole 25*a*. The thermistor mounting member 23 is fixed to the housing 19 by a mounting tool (not illustrated) such as a bolt inserted into the mounting hole 25*a*, and the thermistor 22 is mounted at the housing 19 via the thermistor mounting member 23.

Figure 8:
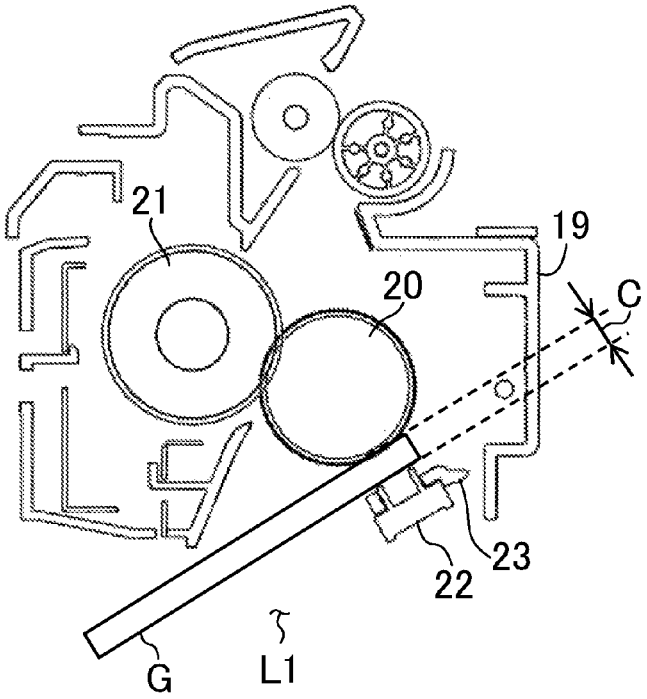
FIG. 8 is a sectional view illustrating an internal structure of a fixing device when a gap between a fixing roller and a thermistor is measured.

The first plate part 24 is integrally formed at one long side thereof with a rectangular second plate part (an exposure part) 26 and a third plate part (an exposure part) 27 spaced apart from each other. The second plate part 26 and the third plate part 27 are respectively formed so as to be perpendicular to the first plate part 24, and a space between the second plate part 26 and the third plate part 27 corresponds to the thermistor 22. At the place corresponding to the thermistor, an insertion part 28, through which a thickness gage G (see FIG. 8) is inserted in order to measure the gap C between the fixing roller 20 and the thermistor 22, is formed.

A long windbreak plate 29 is assembled to the thermistor mounting member 23. In addition, the measurement of the gap C by the thickness gage G is performed in a stage before the windbreak plate 29 is assembled.

As described above, after the thermistor 22 is mounted at the paper entry path L1 side of the housing 19 in the thermistor mounting member 23, in the stage before the windbreak plate 29 is assembled, the thickness gage G is inserted into the insertion part 28 of the thermistor mounting member 23 to measure the gap C between the fixing roller 20 and the thermistor 22, so that it is possible to appropriately set the gap C and to accurately measure the temperature of the fixing roller 20.

The windbreak plate 29 is formed at one long side thereof with two rectangular first and second notched parts 30 and 31. The first notched part 30 and the second notched part 31 are respectively formed in correspondence to the second plate part and the third plate part 27 of the thermistor mounting member 23. In relation to the first notched part 30 and the second notched part 31, in the state in which the windbreak plate 29 has been fixed to the housing 19, the second plate part 26 is fitted into the first notched part 30, the third plate part 27 is fitted into the second notched part 31, and a plate piece 29*a* between the first notched part 30 and the second notched part 31 is fitted into the insertion part 28, so that the thermistor 22 is covered by the windbreak plate 29 from the paper entry path L1 side.

Figure 2:
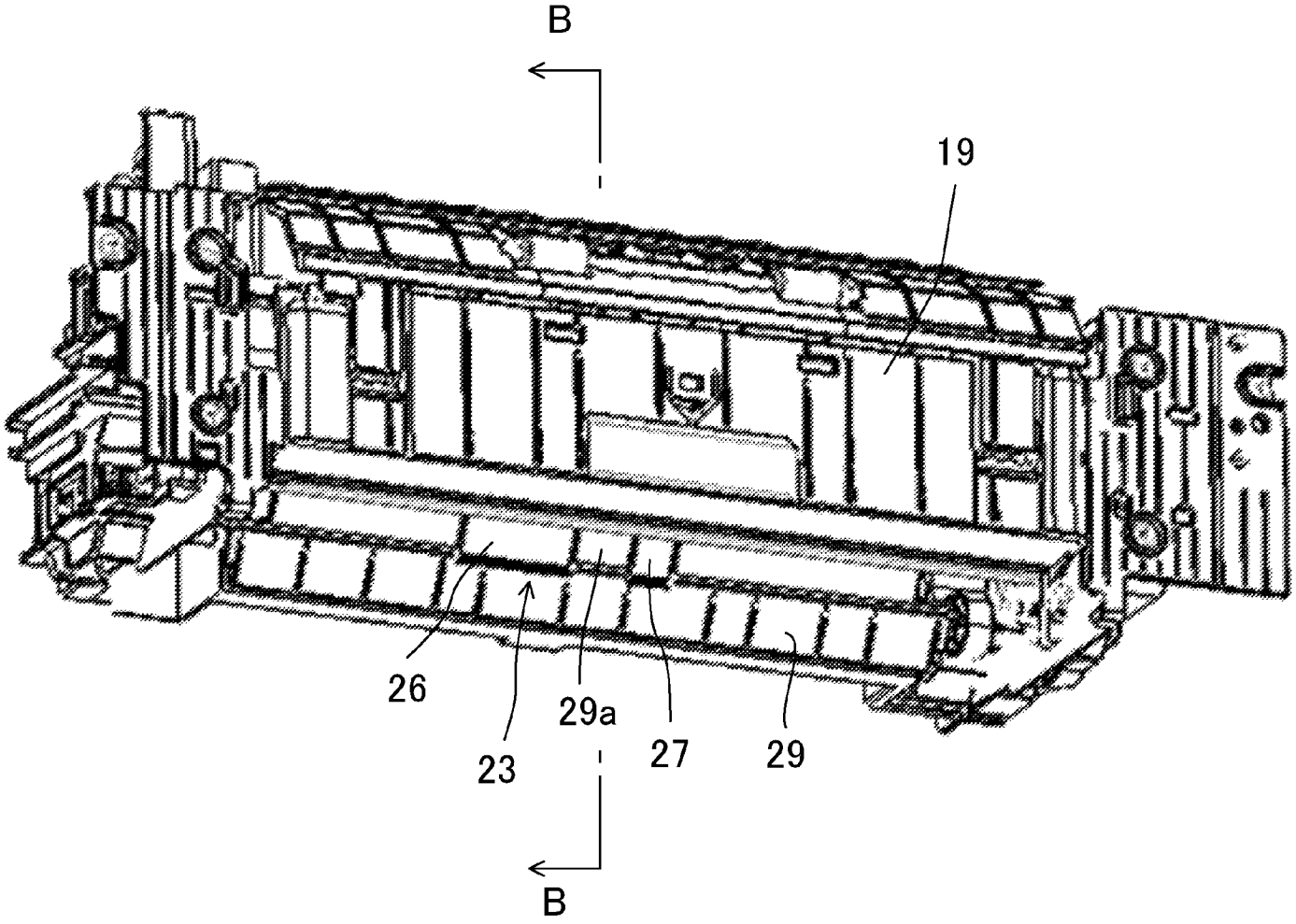
FIG. 2 is a perspective view illustrating an external appearance of a fixing device when viewed from a direction of an arrow A of FIG. 1.
Figure 3:
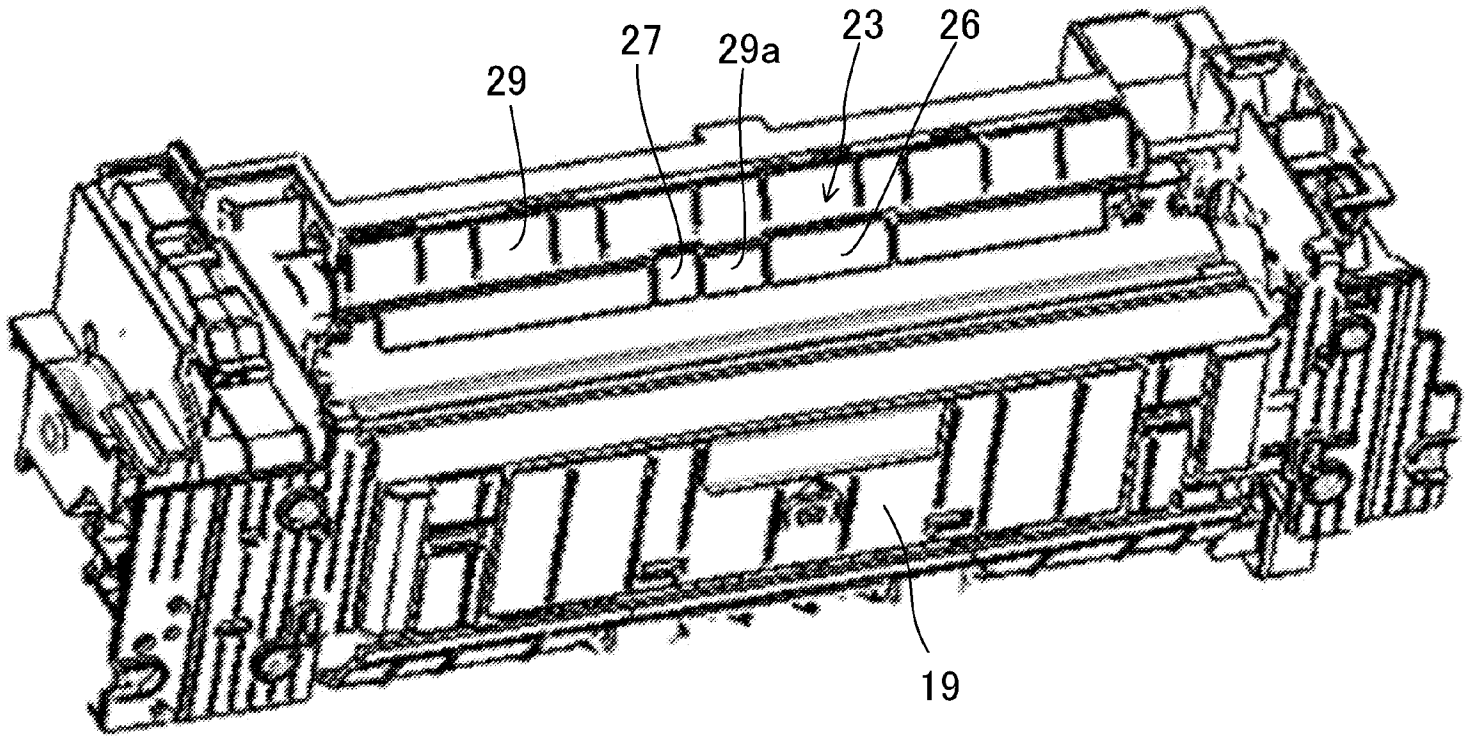
FIG. 3 is a perspective view illustrating an external appearance of a fixing device of FIG. 2 when the fixing device has been inverted in a vertical direction.

In this way, as illustrated in FIG. 2 to FIG. 4, the second plate part 26 and the third plate part 27 are exposed to the paper entry path L1 side from the windbreak plate 29 and are level with the windbreak plate 29 (forming the same plane), thereby constituting a part of the windbreak plate 29. Furthermore, the windbreak plate 29 covers the thermistor 22 from the paper entry path L1 side.

Consequently, the windbreak plate 29 blocks the thermistor 22 and the paper entry path L1, so that it is possible to prevent temperature misdetection of the thermistor 22 due to an influence of outside air temperature.

Furthermore, the thermistor mounting member 23 and the windbreak plate 29 are integrally formed with each other at one place, so that it is possible to achieve a compact fixing device 7.

Moreover, the second plate part 26 and the third plate part 27 of the thermistor mounting member 23 and the windbreak plate 29 are configured to be level with each other (that is, the second plate part 26 and the third plate part 27 are configured to constitute a part of the windbreak plate 29), so that the paper entry path L1 (a paper entry space) is expanded by the thicknesses of each plate part 26, 27. In this way, when the paper P enters into the fixing roller 20, a rear end of the paper P can be prevented from making contact with the windbreak plate 29. Thus, it is possible to prevent a toner image from being distorted by an unfixed toner image on the paper P, which is molten by heat of the windbreak plate 29 heated by the thermal influence of the fixing roller 20.

What is claimed is:

1. A fixing device comprising:

a fixing roller arranged in a housing;

a pressing roller arranged in the housing, the pressing roller being brought into press contact with the fixing roller; and a thermistor that measures a temperature of the fixing roller;

a thermistor mounting member that mounts the thermistor to the housing; and a windbreak plate assembled to the thermistor mounting member and covering the thermistor from a paper entry path side of a paper entering between the fixing roller and the pressing roller, wherein the windbreak plate has a notched part, a part of the thermistor mounting member constitutes an exposure part to be fitted in the notched part and exposed to the paper entry path side from the windbreak plate, and a surface at the paper entry path side of the exposure part is level with a surface at the paper entry path side of the windbreak plate.

2. The fixing device of claim 1, wherein the thermistor is separated from the fixing roller and measures the temperature of the fixing roller in a non-contact manner, at a place of the thermistor mounting member, which corresponds to the thermistor, an insertion part, through which a thickness gauge is inserted in order to measure a gap between the fixing roller and the thermistor, is formed, and after the gap is measured, the insertion part is covered by the windbreak plate from the paper entry path side.

3. An image forming apparatus comprising the fixing device of claim 1.

4. The fixing device of claim 1, wherein the thermistor mounting member has an assembly plate assembled with the thermistor and a perpendicular plate as the exposure part integrally formed at one side of the assembly plate and formed so as to be perpendicular to the assembly plate.

* * * * *